US007465200B2

(12) United States Patent
Mizutani

(10) Patent No.: US 7,465,200 B2
(45) Date of Patent: Dec. 16, 2008

(54) STEERING METHOD AND STEERING SYSTEM FOR BOAT

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/516,151

(22) Filed: Sep. 5, 2006

(65) Prior Publication Data

US 2007/0066156 A1 Mar. 22, 2007

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | |
|---|---|---|---|
| 2,215,003 | A | 9/1940 | Johnson |
| 2,224,357 | A | 12/1940 | Pecker |
| 3,084,657 | A | 4/1963 | Elmer |
| 3,233,691 | A | 2/1966 | De Biasi |
| 3,310,021 | A | 3/1967 | Shimanckas |
| 3,349,744 | A | 10/1967 | Mercier et al. |
| 4,120,258 | A | 10/1978 | Spurgin |
| 4,220,111 | A | 9/1980 | Krautkremer et al. |
| 4,373,920 | A | 2/1983 | Hall et al. |
| 4,500,298 | A | 2/1985 | Hall et al. |
| 4,519,335 | A | 5/1985 | Krautkremer et al. |
| 4,637,802 | A | 1/1987 | Taguchi et al. |
| 4,787,867 | A | 11/1988 | Takeuchi et al. |
| 4,872,857 | A | 10/1989 | Newman et al. |
| 4,908,766 | A | 3/1990 | Takeuchi |
| 4,909,765 | A | 3/1990 | Riske et al. |
| 5,029,547 | A | 7/1991 | Novey |
| 5,031,562 | A | 7/1991 | Nakase et al. |
| 5,231,888 | A | 8/1993 | Katahira |
| 5,235,927 | A | 8/1993 | Singh et al. |
| 5,244,426 | A | 9/1993 | Miyashita et al. |
| 5,253,604 | A | 10/1993 | Bohlin |

(Continued)

FOREIGN PATENT DOCUMENTS

| | | |
|---|---|---|
| JP | 62-166193 | 7/1987 |

(Continued)

OTHER PUBLICATIONS

Co-Pending U.S. Patent Application, filed Oct. 25, 2006. Title: Control Unit for Multiple Installation of Propulsion Units.

(Continued)

*Primary Examiner*—Stephen Avila
(74) *Attorney, Agent, or Firm*—Knobbe, Martens, Olson & Bear, LLP

(57) ABSTRACT

A steering method for a boat with a marine propulsion unit at the stern is provided in which a reaction torque is applied to a steering wheel in response to external force to the boat. The steering method includes: detecting a steering angle and the behavior of the boat; determining whether or not the turning of the steering wheel is in an initial phase based on the detected steering angle and the behavior of the boat; and applying the reaction torque to the steering wheel in response to the determination.

10 Claims, 9 Drawing Sheets

U.S. PATENT DOCUMENTS

| | | | | |
|---|---|---|---|---|
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,855,014 | B2 * | 2/2005 | Kinoshita et al. | 440/1 |
| 6,892,661 | B2 | 5/2005 | Kishi et al. | |
| 6,892,662 | B2 | 5/2005 | Watanabe et al. | |
| 6,994,046 | B2 | 2/2006 | Kaji et al. | |
| 6,997,763 | B2 | 2/2006 | Kaji | |
| 7,004,278 | B2 * | 2/2006 | Sugitani et al. | 180/402 |
| 7,063,030 | B2 | 6/2006 | Mizutani | |
| 2003/0077953 | A1 | 4/2003 | Kaji | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 * | 6/2005 | Gronau et al. | 303/146 |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0215131 | A1 | 9/2005 | Oguma et al. | |
| 2005/0282447 | A1 | 12/2005 | Okuyama | |
| 2006/0019558 | A1 | 1/2006 | Mizutani | |
| 2006/0037522 | A1 | 2/2006 | Kaneko et al. | |
| 2006/0180070 | A1 | 8/2006 | Mizutani | |
| 2006/0217012 | A1 | 9/2006 | Mizutani | |
| 2007/0049139 | A1 | 3/2007 | Mizutani | |
| 2007/0066157 | A1 | 3/2007 | Yamashita et al. | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 03-148395 | 6/1991 |
| JP | 04-038297 | 2/1992 |
| JP | B-HEI 6-33077 | 5/1994 |
| JP | 2739208 | 1/1998 |
| JP | 10-226346 | 8/1998 |
| JP | A-HEI 10-310074 | 11/1998 |
| JP | 2959044 | 7/1999 |
| JP | 2000-318691 | 11/2000 |
| JP | 2003-313398 | 11/2000 |
| JP | 3232032 | 9/2001 |
| JP | A-2002-331948 | 11/2002 |
| JP | A-2004-155282 | 6/2004 |
| JP | 2005-254848 | 9/2005 |

OTHER PUBLICATIONS

Co-Pending U.S. Patent Application, filed Sep. 5, 2006. Title: Steering System for a Small Boat.

Co-Pending U.S. Patent Application, filed Nov. 6, 2006. Title: Electric Type Steering Device for Outboard Motors.

Co-pending U.S. Appl. No. 11/942,179, filed Nov. 19, 2007. Title: Watercraft Steering Device and Watercraft.

Co-pending U.S. Appl. No. 11/942,187, filed Nov. 19, 2007. Title: Watercraft Steering System, and Watercraft.

Co-pending U.S. Appl. No. 11/942,159, filed Nov. 19, 2007. Title: Watercraft Steering Device and Watercraft.

* cited by examiner (A)

(B)

| Physical quantity | Initial phase of turning | During steering movement |
|---|---|---|
| Steering angle α | + | + |
| Roll angle Θ | + | + |
| Yaw rate γ | + | + |
| Lateral acceleration G | − | + |

STEERING METHOD AND STEERING SYSTEM FOR BOAT

PRIORITY INFORMATION

The present application is based on and claims priority under 35 U.S.C. § 119 Japanese Patent Application No. 2005-254759, filed on Sep. 2, 2005, the entire contents of which are expressly incorporated by reference herein.

BACKGROUND OF THE INVENTIONS

1. Field of the Inventions

The present inventions relate to steering methods and steering systems for boats.

2. Description of the Related Art

Boats with a marine propulsion unit such as outboard motors and stern drives (hereinafter simply referred to as "outboard motor") mounted to the stern have a steering device with which the outboard motor is pivoted to the left and right of the hull for steering control.

An electric steering apparatus using an electric motor as a steering device for an outboard motor is disclosed in Japanese Patent Document JP-B-2739208. In this electric steering system, the external forces imparted to the outboard motor are not applied to the steering wheel during boat operator's steering operation. Thus, the boat operator is not provided with a steering feeling in response to such external forces, i.e., a heavy or light feel of the steering wheel depending on steering speed or steering angles, or a steering feeling caused by the external force such as wind or waves. With this lack of feeling of the steering system during steering, the boat operator is less able to detect and react quickly to such external forces. As such, it is more difficult for the operator to compensate for the effects of these forces on the movement of the boat.

Japanese Patent Document JP-B-2959044 discloses a steering method in which a reaction torque is applied to the steering wheel in response to a steering angle allowing for external forces caused by the rotation of a propeller of the boat (known as the "paddle-rudder effect" or the "gyro effect"). In this steering method, the reaction torque to be applied is not optimum to the attitude and speed of the boat or the behavior of the boat related to a yaw rate and lateral acceleration, making it difficult for the boat operator to realize the operating conditions and respond appropriately and promptly to the behavior of the boat as influenced by the external forces.

A steering apparatus for an automobile is disclosed in Japanese Patent Document JP-A-Hei 10-226346. This steering apparatus also includes a reaction force motor. This system calculates a reaction torque to be applied to the steering wheel based on detected vehicle speed, yaw rate and the like, and causes the reaction motor to apply a reaction force.

Since boats are designed to float on water and to apply thrust to the hull via the water in which they float, the behavior of such boats are unlike that of automobiles and thus are unique. Therefore, it is impossible to apply the steering device disclosed in Japanese Patent Document JP-A-Hei 10-226346 directly to the boats to implement the application of reaction torque.

SUMMARY OF THE INVENTIONS

An aspect of at least one of the embodiments disclosed herein includes the realization that boats, such as those with outboard motors, have such characteristics that the hull is forced to tilt in a centripetal direction during a turn, to the contrary to automobiles, for example. This stems from the characteristic that the boat floats on water and thrust is applied to a region of the outer rear face of the hull located under the water. Therefore, due to the smaller lateral centrifugal force to the boat operator, as well as the interaction between the lateral centrifugal force and the component of the gravity produced with the boat tilted in a centripetal direction, the total lateral centrifugal force to the boat operator will be decreased during a turn.

Thus, in accordance with an embodiment, a method for steering a boat with a marine propulsion unit at the stern, in which a reaction torque is applied to a steering wheel in response to external force to the boat can be provided. The method can comprise detecting a steering angle and the behavior of the boat and determining whether or not the turning of the steering wheel is in an initial phase based on the detected steering angle and the behavior of the boat. Additionally, the method can include applying the reaction torque to the steering wheel in response to the determination.

In accordance with another embodiment, a steering system for a boat can comprise a marine propulsion unit mounted to the stern through a steering device and a reaction motor configured to apply a reaction torque to a steering wheel of the boat in response to external force to the boat. The steering system can also include a steering angle sensor and a boat behavior detection device. A controller can also be configured to determine the reaction torque, the controller also being configured to determine whether or not the turning of the steering wheel is in an initial phase based on a steering angle and the behavior of the boat, and to determine the reaction torque based on the whether or not the steering wheel is in an initial phase.

In accordance with a further embodiment, a steering system for a boat can comprise a marine propulsion unit mounted to the stern through a steering device and a reaction motor configured to apply a reaction torque to a steering wheel of the boat in response to external force to the boat. The steering system can also include a steering angle sensor and means for determining the reaction torque based on whether or not the turning of the steering wheel is in an initial phase based on a steering angle and a behavior of the boat.

BRIEF DESCRIPTION OF THE DRAWINGS

These and other features, aspects, and advantages of the present inventions are described below with reference to the drawings of preferred embodiments, which embodiments are intended to illustrate and not to limit the present inventions.

DETAILED DESCRIPTION OF THE PREFERRED EMBODIMENTS

Figure 1:
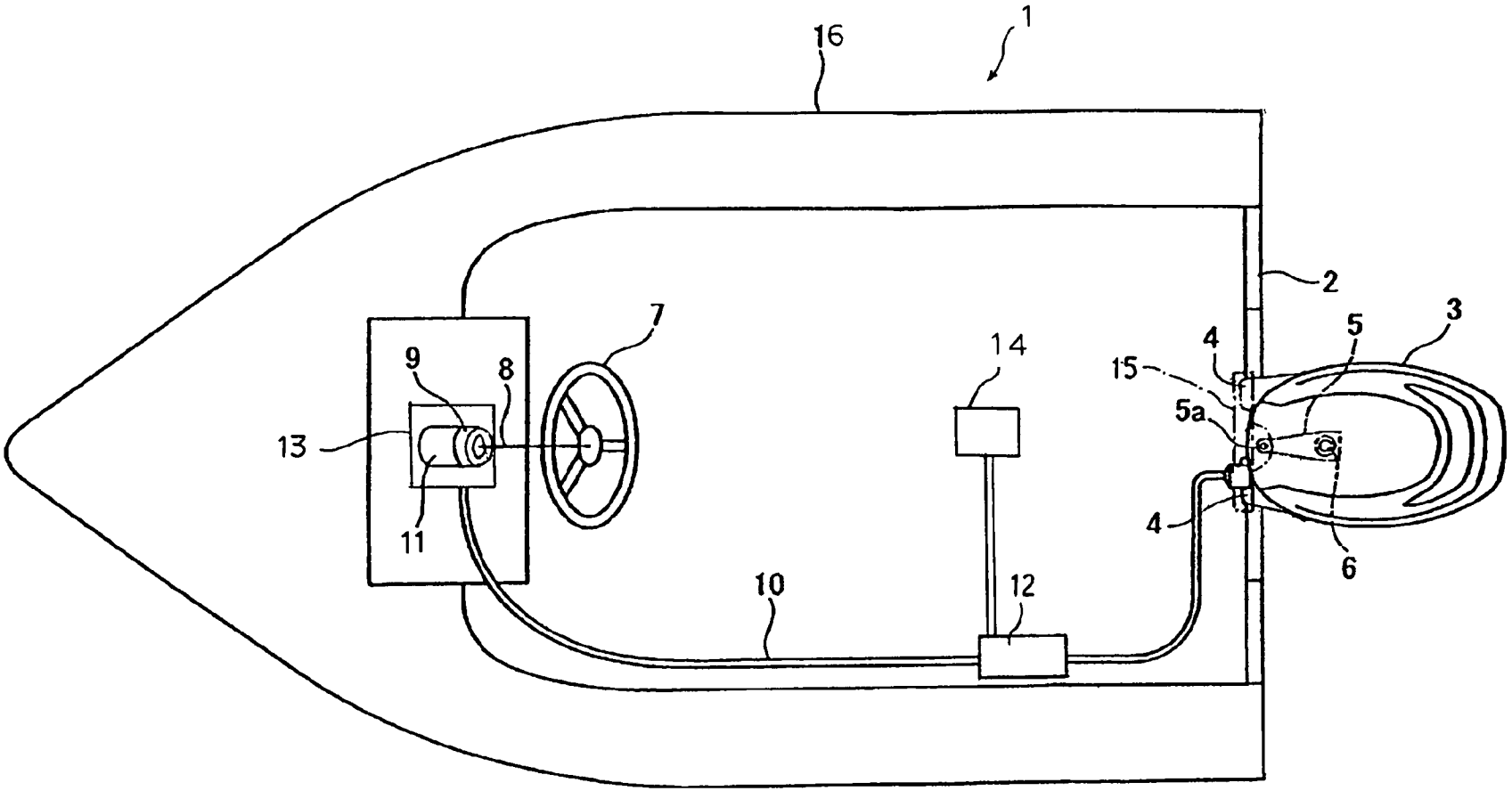
FIG. 1 is a schematic top plan view of a small boat having a steering system in accordance with an embodiment.

FIGS. 1-9 illustrate a steering system for a boat 1 configured in accordance with certain features, aspects, and advantages of at least one of the inventions described herein. The boat 1 merely exemplifies one type of environment in which the present inventions can be used. However, the various embodiments of the steering systems disclosed herein can be used with other types of boats or other vehicles that benefit from improved steering control. Such applications will be apparent to those of ordinary skill in the art in view of the description herein. The present inventions are not limited to the embodiments described, which include the preferred embodiments, and the terminology used herein is not intended to limit the scope of the present inventions.

The small boat 1 can have a hull 16 including a transom plate 2 to which an outboard motor 3 can be mounted through clamp brackets 4. The outboard motor 3 can be pivotable about a swivel shaft (steering pivot shaft) 6 extending substantially in a vertical direction.

The swivel shaft 6 can have an upper end at which a steering bracket 5 can be fixed. The steering bracket 5 can have a forward end 5*a* to which a steering device 15 can be coupled.

The steering device 15 can include, for example but without limitation, a DD (Direct Drive) type electric motor having a motor body (not shown in FIG. 1). The motor body can be adapted to slide along a threaded shaft (not shown in FIG. 1) extending parallel to the ransom plate 2. The steering device 15 is described in grater detail below with reference to FIG. 3.

With continued reference to FIG. 1, the forward end 5*a* of the steering bracket 5 can be operatively coupled to the motor body to permit the outboard motor 3 to pivot about the swivel shaft 6 as the motor body can be made to slide.

The boat operator's section of the hull 16 can contain a steering wheel 7 which can serve as a steering input device. A steering control section 13 can be provided at the proximal end of a steering wheel shaft 8 of the steering wheel 8. The steering control section 13 can have a steering angle sensor 9 and a reaction force motor 11. The steering control section 13 can be connected to a controller (ECU) 12 via a signal cable 10. The controller 12 can be connected to the steering device 15.

The controller 12 can be connected to a behavior detection device 14. The behavior detection device 14 can include at least one of a yaw rate sensor, a lateral acceleration sensor, a speed sensor, and a roll angle sensor. In some embodiments, the behavior detection device 14 includes all of these sensors. However, the behavior detection device 14 can also include other sensors.

The controller 12 can be configured to detect the amount of steering wheel displacement by boat operator's steering wheel 7 operation based on a detection signal from the steering angle sensor 9. Using the detected amount of steering wheel displacement and in response to running conditions such as speed and an acceleration/deceleration state, the controller 12 can determine a target steering angle β to be achieved by the steering device 15. The controller 12 can then transmit a target steering angle command signal to the steering device 15 to actuate the DD type motor of the steering device 15 so that the outboard motor 3 pivots about the swivel shaft 6 for steering movement.

The controller 12 can also be configured to cause the reaction motor 11 to apply a reaction torque to the steering wheel 7. For example, the controller 12 can also be configured to determine and apply a reaction force in response to parameters such as, for example, but without limitation, the steering angle and other behaviors of the boat.

Figure 2:
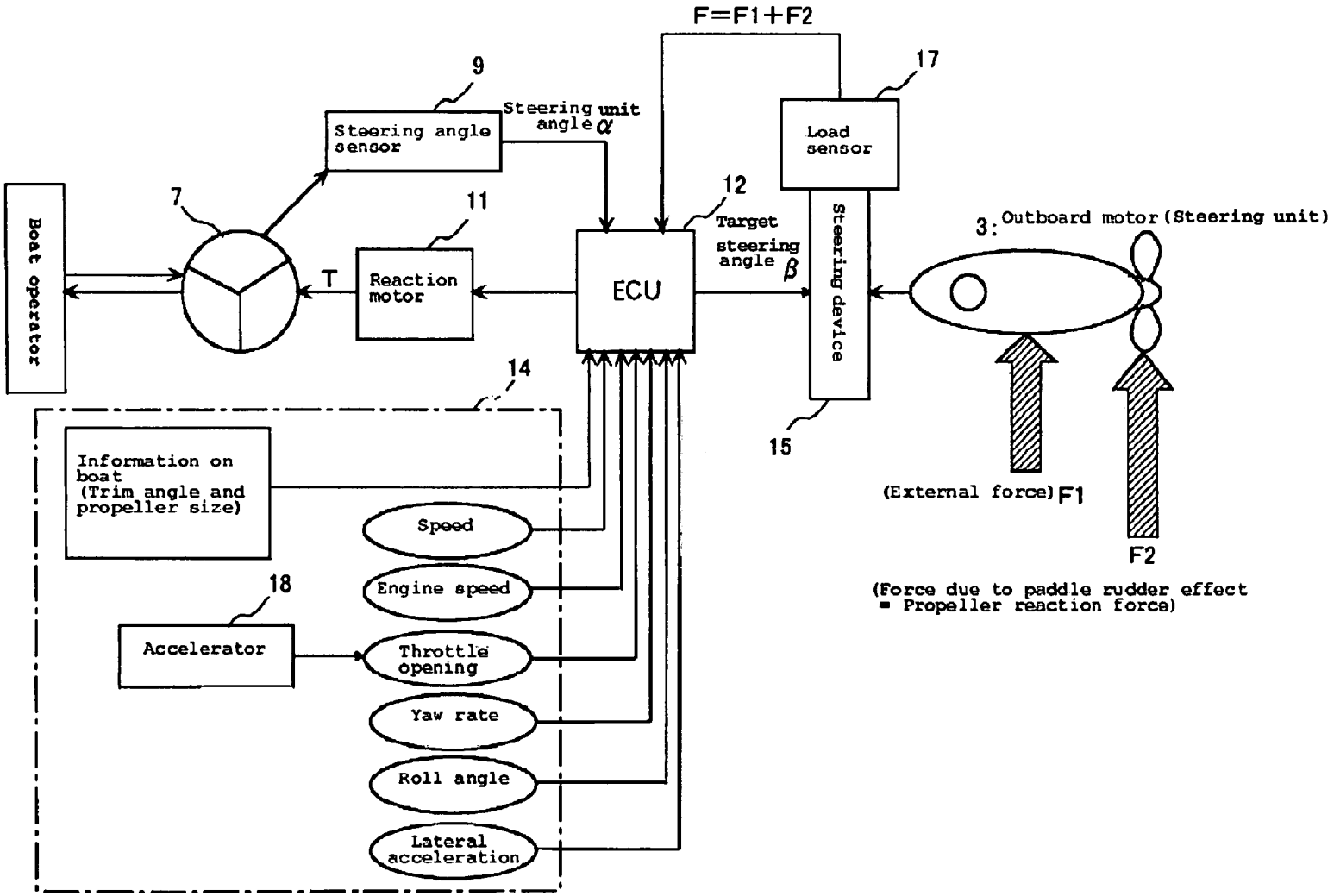
FIG. 2 is a schematic and partial block diagram illustrating a configuration that can be used for the steering system of the boat of FIG. 1.

With reference to FIG. 2, during operation, the outboard motor 3 can experience an external force F1, such as those forces caused by wind or waves, as well as a resistance force against its pivotal movement during steering movements. Also, the outboard motor 3 can experience a propeller reaction force F2 caused by the rotation of the propeller, or a certain deflection force to the propulsion unit (outboard motor 3) to propel the boat in a certain deflected direction (known as the "paddle-rudder" effect).

As the outboard motor 3 is deflected by the steering device 15, a resultant force "F" resulting from the external force F1 and the propeller reaction force F2, acts on the outboard motor 3 and thus acts on the steering device 15. This force F can be referred to as a steering unit moving load acting on the steering device 15. The steering unit moving load "F" (=F1+F2) can be detected by a load sensor 17. The steering unit moving load "F" can be input to the controller 12.

As a boat operator turns the steering wheel 7 to steer the boat, the amount of the steering wheel displacement (e.g., the steering input command) can be detected by the steering angle sensor 9, and this detection information on the steering input angle α can be input to the controller 12. The controller 12 can also receive input of information on the boat including a trim angle of the outboard motor 3 and a propeller size. The controller 12 can also receive input of information on boat speed, engine speed, throttle opening, yaw rate, attitude (roll angle), and lateral acceleration.

The controller 12 can be configured to use such information to detect the behavior of the boat 1. As the boat operator operates an accelerator 18 such as acceleration lever (not shown) so as to accelerate or decelerate (also referred to as negative acceleration), a throttle valve operatively connected to the accelerator opens or closes during transient operation. The throttle opening during acceleration or deceleration can be detected by a throttle opening sensor (not shown) provided on a throttle shaft. Throttle opening information can be a detection signal from the throttle opening sensor or a detection signal of the amount of accelerator 18 displacement.

The controller 12 can be configured to determine a target steering angle β of the outboard motor 3 corresponding to the steering angle α in response to running conditions based on the input information on the boat 1 and others. For example, the controller 12 can be configured to use predetermined steering unit characteristics for such determinations. However, the controller 12 can also be configured to use other characteristics.

The controller 12 can be configured to execute a determination of a target steering angle β and engine operation control. The controller 12 can also be configured to execute a determination of a reaction force corresponding to the amount of steering wheel displacement in response to running conditions and external forces and to drive the reaction force motor 11 to apply the determined reaction force to the steering wheel 7 so as to provide an improved boat operation feeling for the operator.

Figure 3:
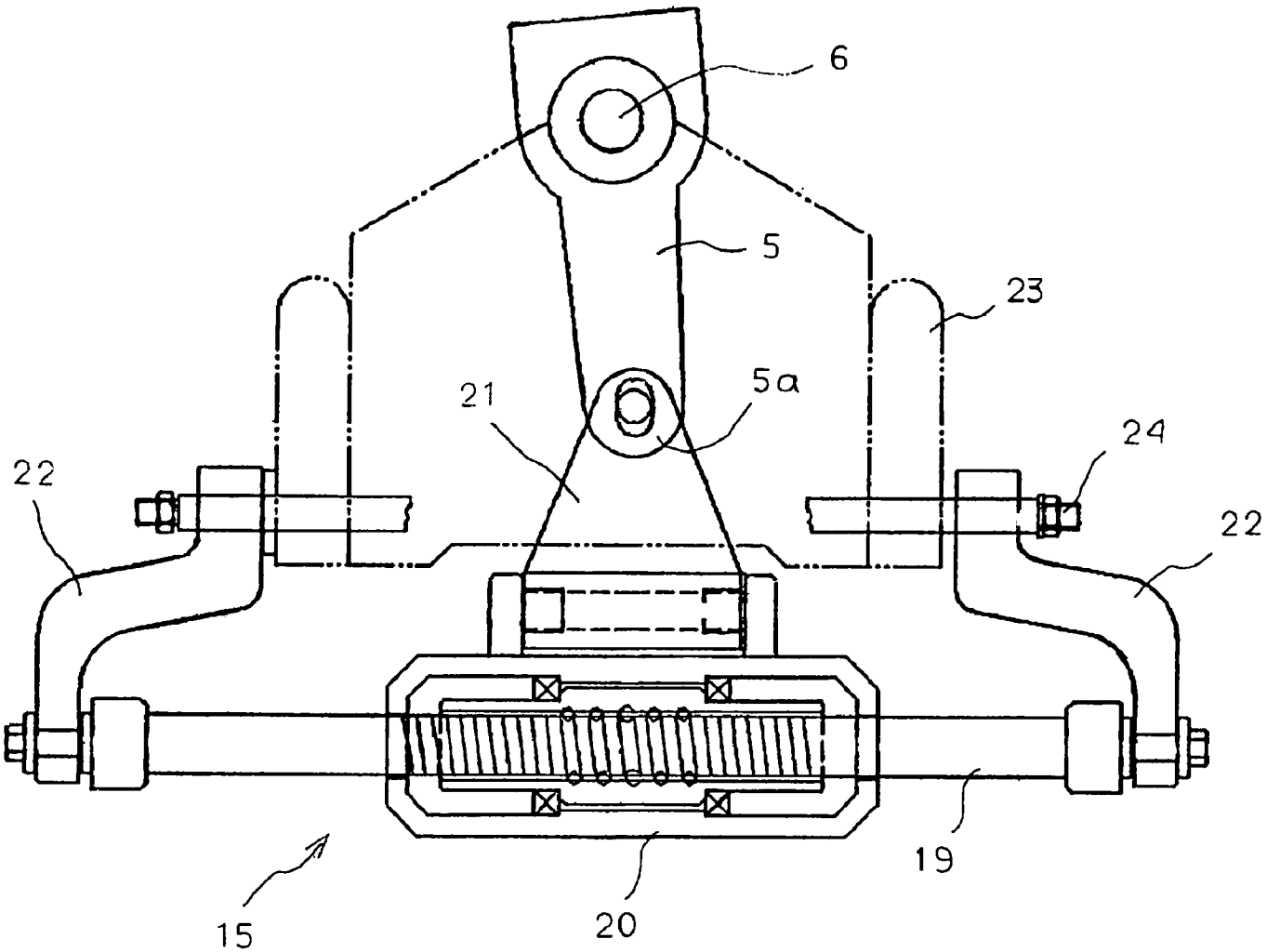
FIG. 3 is a schematic top plan and partial cutaway view of a steering device that can be used with the boat and/or the steering system of FIGS. 1 and 2.
Figure 4:
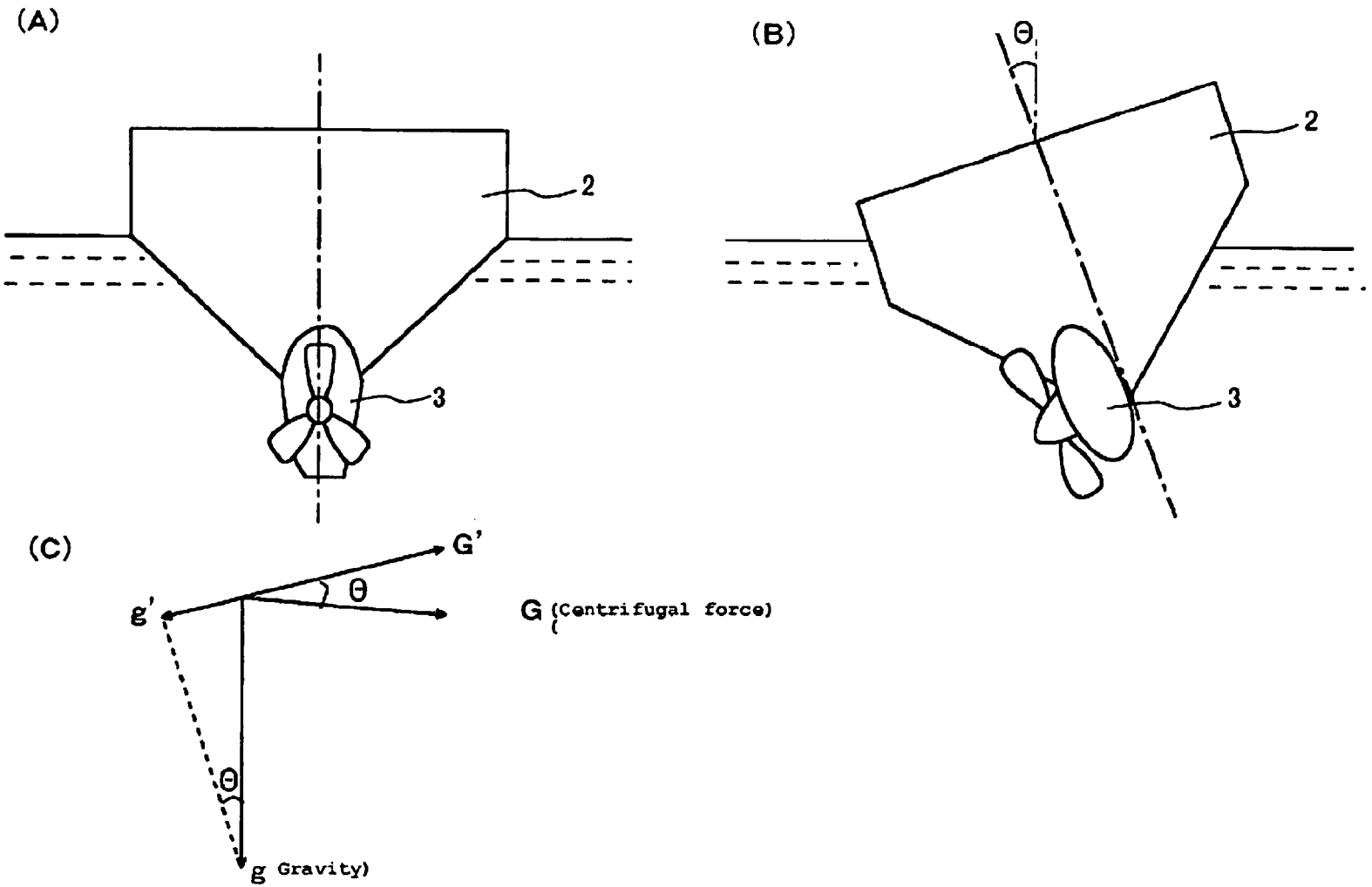
FIGS. 4(A) and 4(B) are schematic rear elevational views of the boat of FIG. 1 illustrating a change in roll angle from straight ahead operation to a turning operation.
FIG. 4(C) is a vector diagram illustrating a change in certain force vectors during the transition from straight ahead operation to a turning operation.
Figure 5:
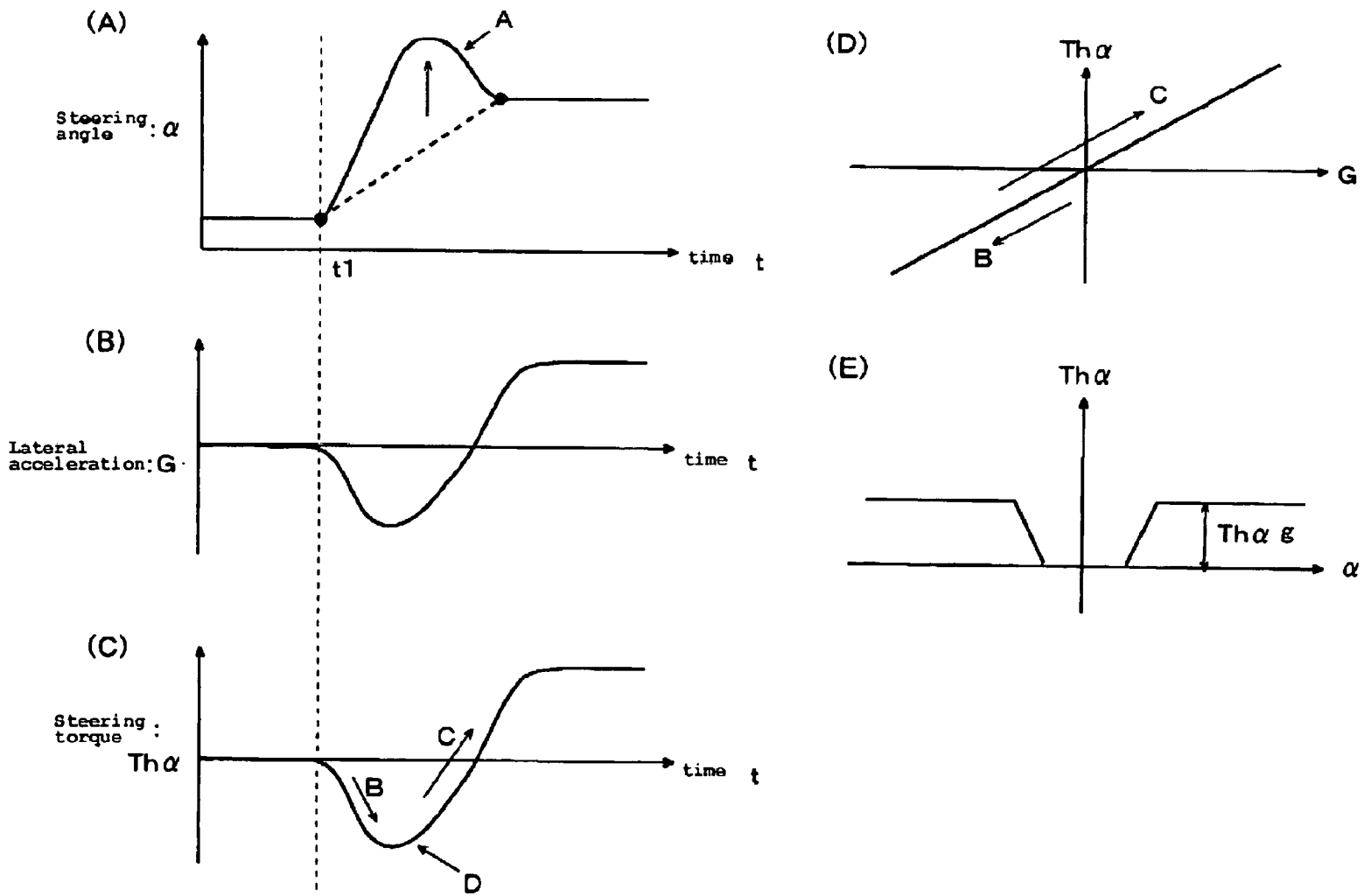
FIGS. 5(A), 5(B), 5(C), 5(D) and 5(E) are graphs illustrating exemplary changes of certain steering characteristics during operation of the boat, including changes in reaction torque applied to a steering wheel in response to lateral acceleration.
Figure 6:
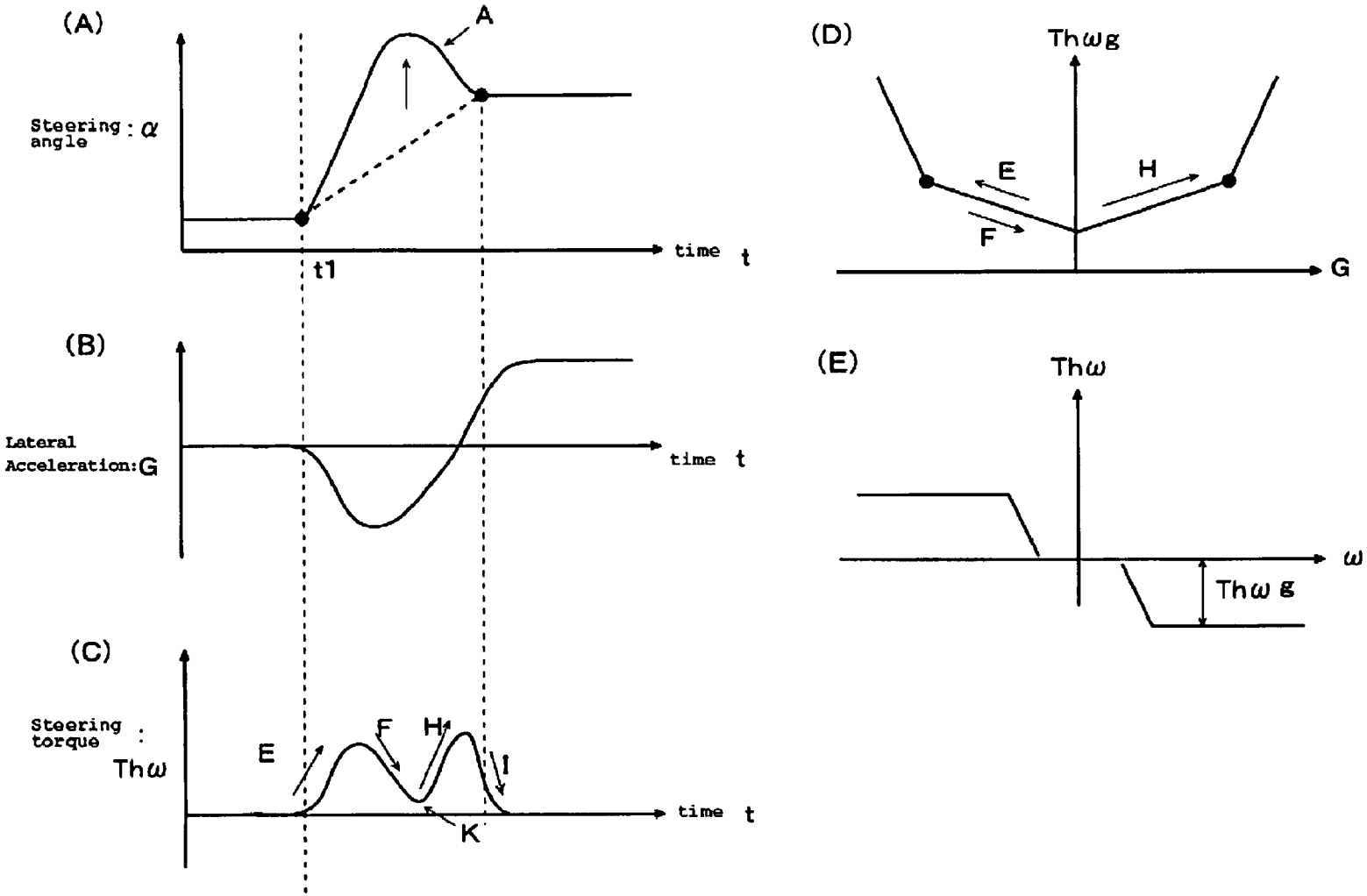
FIGS. 6(A), 6(B), 6(C), 6(D) and 6(E) are graphs illustrating exemplary changes of certain steering characteristics during operation of the boat, including changes in weight of the steering wheel in response to lateral acceleration.

With reference to FIG. 3, the steering device 15 can include an electric motor 20 mounted on a threaded rod 19 and adapted to slide along the threaded rod 19. The threaded rod 19, at its longitudinal ends, can be fixed to the transom plate (not shown) with support members 22. Thus, the threaded rod 19 remains in a fixed position.

Reference numeral 23 denotes a clamp part of the clamp bracket. Reference numeral 24 denotes a tilt shaft 24. The steering bracket 5 can be fixed on the swivel shaft 6 of the outboard motor 3 (see FIG. 1), and the forward end 5*a* of the steering bracket 5 can be coupled to the electric motor 20 through the coupling bracket 21.

In such structure, as the electric motor 20 is driven to slide along the threaded rod 19, which remains in a fixed position, the electric motor 20 pivots the steering bracket 5 and thus pivots the outboard motor 3 about the swivel shaft 6 for steering movement.

FIG. 4(A) is a schematic rear elevational view of the boat 1 moving in a straight ahead direction. The outboard motor 3, which is mounted to the transom plate 2, is directed straight rearward.

FIG. 4(B) schematically illustrates the behavior of the boat 1 during a left turn. During the left turn, the outboard motor 3 is moved or pivoted leftward so as to direct the thrust partially rightwardly. The stem of the boat 1 is thereby pushed rightwardly and forwardly to direct the front of the hull leftwardly, thereby turning the hull to the left. At this time, the outboard motor 3 applies the rightward thrust to the hull in water, so that the hull tilts leftward (in a centripetal direction). Namely, the boat assumes an attitude with a centripetal roll angle of $\theta$.

FIG. 4(C) illustrates a lateral acceleration to the boat operator in the state of the boat making a left turn shown in FIG. 4(B). During the left turn, the boat operator undergoes vertically downward gravity g and a lateral centrifugal force (lateral acceleration) G. With a centripetal roll angle of $\theta$, a lateral centrifugal force G' to the boat operator is obtained by: $G'=G \cos\theta$. Assuming that a lateral component of the gravity g is g', which is obtained by $g'=g \sin\theta$, g' is applied to the boat operator in a lateral centripetal direction.

Therefore, a centrifugal acceleration G" to the boat operator when the boat is tilted is obtained by $G''=G'-g'=G\cos\theta-g\sin\theta$, meaning that G is decreased compared to when the boat is in a horizontal state. Thus, in the actual turning process of the boat, when the turning of the steering wheel begins in a straightforward state, the boat is forced to tilt in a centripetal direction, and the lateral acceleration becomes negative (centripetal) as shown in FIG. 5(B) described below. Such behavior is contrary to that of automobiles or the like.

Some of the embodiments disclosed herein are directed to the application of an optimum reaction force to boat operator's steering wheel 7 so as to prevent an abrupt change in the attitude and behavior of the boat 1.

Boats with an outboard motor have such characteristics that the hull is forced to tilt in a centripetal direction during a turn, to the contrary to automobiles, for example. This comes from another characteristics of the boat that the hull floats on water and thrust is applied to a region of the outer rear face of the hull located under the water. Therefore, due to the smaller lateral centrifugal force to the boat operator, as well as the interaction between the lateral centrifugal force and the component of the gravity produced with the boat tilted in a centripetal direction, the total lateral centrifugal force to the boat operator will be decreased.

FIG. 5(A) illustrates exemplary changes in steering input angles $\alpha$ over time t. Thus, FIG. 5(A) illustrates an example of how an operator might turn the steering wheel 7 during operation of the boat 1.

In FIG. 5(A), at time point t1 when the turning of the steering wheel begins, if a reaction torque is applied to the steering wheel only in response to the steering angle $\alpha$, the steering wheel 7 will feel too light due to the low reaction force, possibly resulting in the excessive turning of the steering wheel 7 (during the portion of the movement identified as "A"), since for the boat 1, lateral acceleration becomes negative in the initial phase of the turning of the steering wheel 7 as described above.

FIG. 5(B) illustrates the change in lateral acceleration G resulting from the movement shown in FIG. 5(A). Assuming that a centrifugal direction is positive, the lateral acceleration first becomes negative (centripetal) at time point t1 when the turning of the steering wheel 7 begins, and gradually becomes positive (centrifugal) thereafter. In other words, in the initial phase of the turning of the steering wheel 7, the boat 1 rolls in a centripetal direction, and centrifugal force is relatively small due to less responsive turning motion in the initial phase of the turn. The lateral acceleration thus temporarily decreases in the initial phase of the turning of the steering wheel 7 where a component of the rolling force is relatively large.

FIG. 5(C) illustrates the characteristics of reaction torque Th$\alpha$ to the steering wheel 7. As shown in this example, if a negative reaction torque is applied to the steering wheel 7 in the initial phase of the turning of the steering wheel in response to the lateral acceleration shown in FIG. 5(B) (identified as "B"), and thereafter reaction torque to the steering wheel 7 is gradually increased (identified as "C"), the steering wheel 7 will suddenly feel light at "D" where the torque shifts from negative to positive, resulting in the abrupt turning of the steering wheel 7 and possibly excessive unintended turning of the boat 1.

FIG. 5(D) is a graph illustrating a determination of a coefficient Th$\alpha$g for determination of reaction torque to lateral acceleration G. If the coefficient is determined so as to first decrease at B (FIG. 5(D)) and then increase at C (FIG. 5(D)) in response to the B (FIG. 5(C)) and C (FIG. 5(C)), the steering wheel 7 will turn abruptly immediately after reversal of the direction in which reaction torque is applied, as described in FIG. 5(C).

FIG. 5(E) illustrates reaction torque value Th$\alpha$ as a function of steering input angle $\alpha$. The reaction torque Th$\alpha$ can be determined in response to the coefficient Th$\alpha$g. The coefficient Th$\alpha$g increases as lateral acceleration increases. Thus, when lateral acceleration is applied in a centripetal direction, which is negative, reaction torque is applied in the direction in which the steering wheel 7 is turned. In the example shown in FIG. 5(E), no reaction torque is applied for left and right turning of a steering input angles $\alpha$ in the vicinity of approximately 0 degrees so as to prevent an abrupt turn of the steering wheel 7.

FIG. 6(A) illustrates changes in steering input angles $\alpha$ over time t. Thus, FIG. 6(A) illustrates an example of how an operator might turn the steering wheel 7 during operation of the boat 1

As shown in FIG. 6(A), at time point t1 when the turning of the steering wheel 7 begins, if reaction torque is applied only in response to the steering angle, the steering wheel 7 will feel too light due to the reaction force, resulting in excessive turning of the steering wheel 7 at A (FIG. 6(A)), since for the boat 1, lateral acceleration becomes negative at the beginning of the turning of the steering wheel 7 as described above.

FIG. 6(B) illustrates the characteristics of lateral acceleration G. Assuming that the centrifugal direction is positive, the lateral acceleration first becomes negative (centripetal) time point t1 when the turning of the steering wheel 7 begins, and thereafter, gradually becomes positive (centrifugal). In other words, at the beginning of the turning of the steering wheel 7, the boat 1 rolls in a centripetal direction, and centrifugal force is relatively small due to less responsive turning motion in the early stage of the turn. The lateral acceleration thus temporarily decreases at the beginning of the turning of the steering wheel 7 when the component of the rolling force is relatively large.

FIG. 6(C) illustrates the characteristics of a reaction force (reaction torque) Thω which provides "weight" to the feeling of movement of the steering wheel 7. The weight Thω due to reaction force to the steering wheel 7 can be given by the equation, Thω=Thωg×ω, where Thωg is a coefficient in response to lateral acceleration, whose direction is irrelevant, and ω is a steering speed (e.g., rotational speed of the steering wheel 7).

In this example, steering torque (reaction torque) Thω is increased in the initial phase E of the turning of the steering wheel 7, decreased thereafter during phase F, increased again thereafter during phase H, and decreased again thereafter during phase I back to 0 when boat operator's steering wheel operation is over. Using such reaction torque characteristcs, the steering wheel 7 feels heavy temporarily at K part, and then feels light again, which can provide an uncomfortable feeling. In other words, since reaction torque is applied in the direction to permit further turning of the steering wheel 7 immediately after the turning of the steering wheel 7 begins, and thereafter the direction in which the reaction torque applied is reversed to the direction in which the steering wheel 7 is returned to its original position, the boat operator might find steering wheel motion unstable.

Also, since the steering wheel 7 first feels heavy and then feels light, the boat operator might be given an uncomfortable feeling. In this case, if the boat operator turns the steering wheel 7 against the uncomfortable feeling, the direction in which the reaction torque is applied is reversed again, so that the steering wheel 7 feels light immediately after the boat operator applies hand force to the steering wheel 7, possibly resulting in the excessive turning of the steering wheel 7.

FIG. 6(D) is a graph illustrating an exemplary determination of reaction torque Thωg as a function of lateral acceleration G. Reaction torque can be determined in response to lateral acceleration G, for example, corresponding to the E part, the F part and the H part in FIG. 6(C). The use of such reaction torque characteristics can provide an uncomfortable feeling as described above.

FIG. 6(E) is a graph illustrating an exemplary determination of reaction torque Thω as a function of steering speed ω. Thω depends on the coefficient Thωg. When the lateral acceleration G shifts from centripetal to centrifugal, Thω is decreased temporarily. The steering wheel 7 thereby feels light temporarily. This might provide an uncomfortable feeling as described above. The direction of reaction torque Thω is opposite to the direction in which the steering wheel 7 is turned. In other words, when the steering wheel 7 is turned in a positive direction (e.g., right turning direction), reaction torque is applied in a negative direction (left turning direction).

In some of the present embodiments, no reaction torque is applied for left and right turning at or over a range of steering speeds ω of or in the vicinity of approximately 0 (when the steering wheel is approximately in the neutral position) so as to eliminate an uncomfortable feeling during steering operation, as shown in the example of FIG. 6(E).

Figure 7:
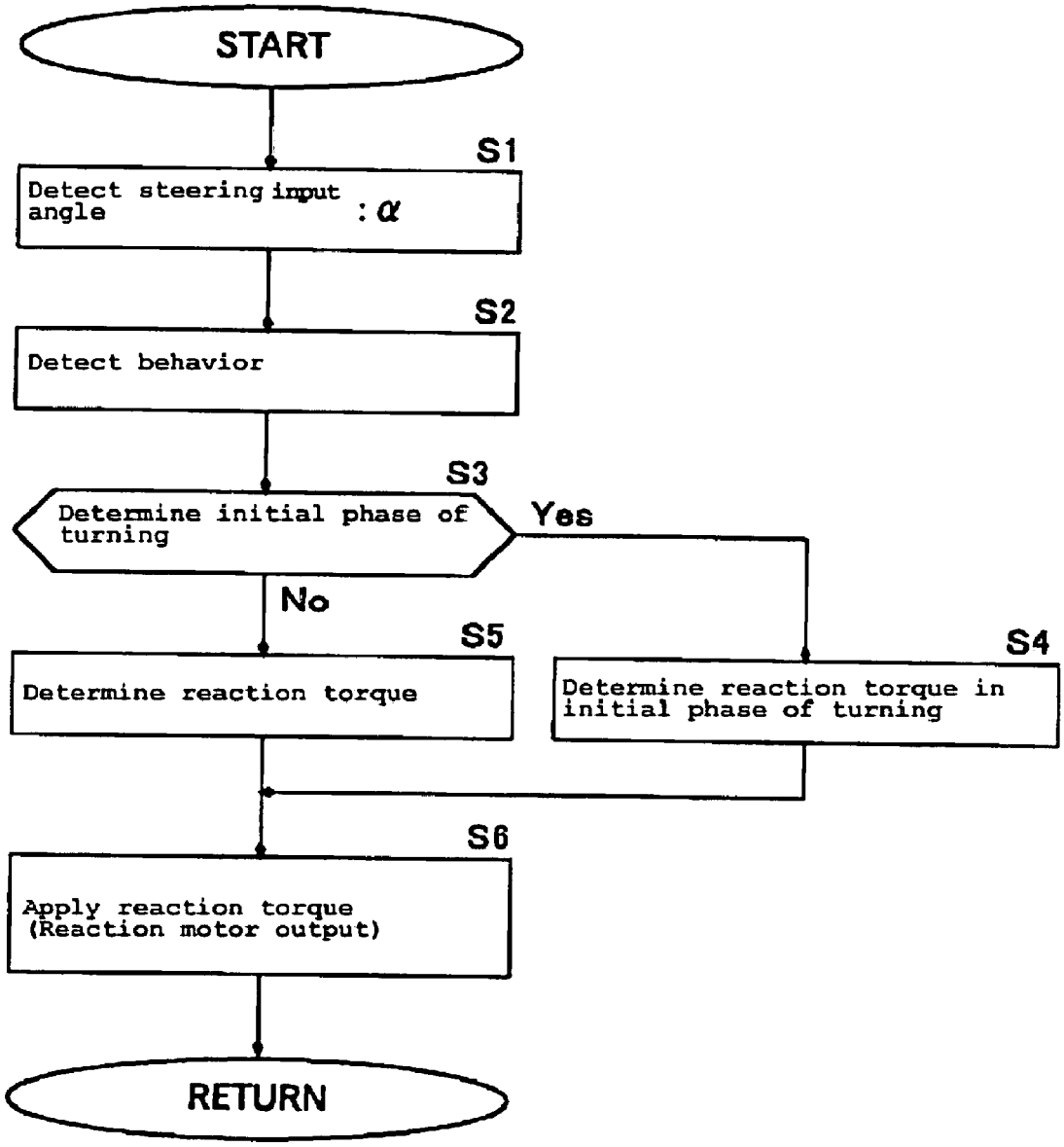
FIG. 7 is a flowchart of the steering operation that can be used during operation of the steering system.
Figure 8:
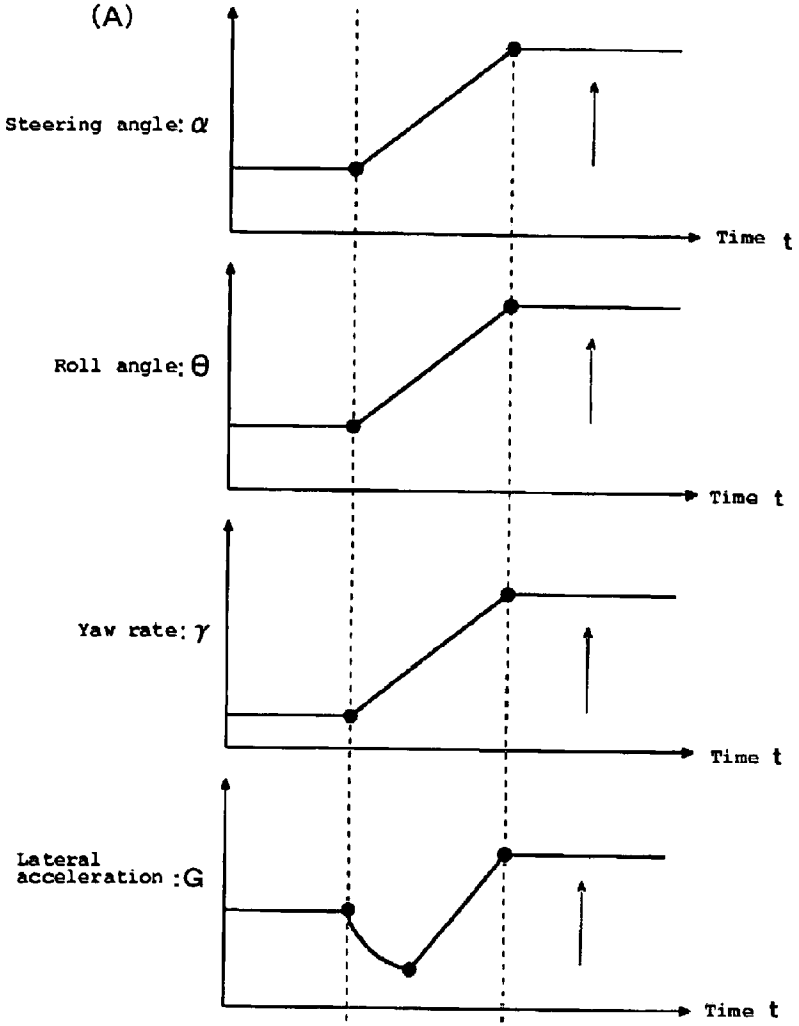
FIGS. 8(A) and 8(B) are timing diagrams and a data table illustrating an exemplary method for determining steering characteristics for the initial phase of turning of the steering wheel.
Figure 9:
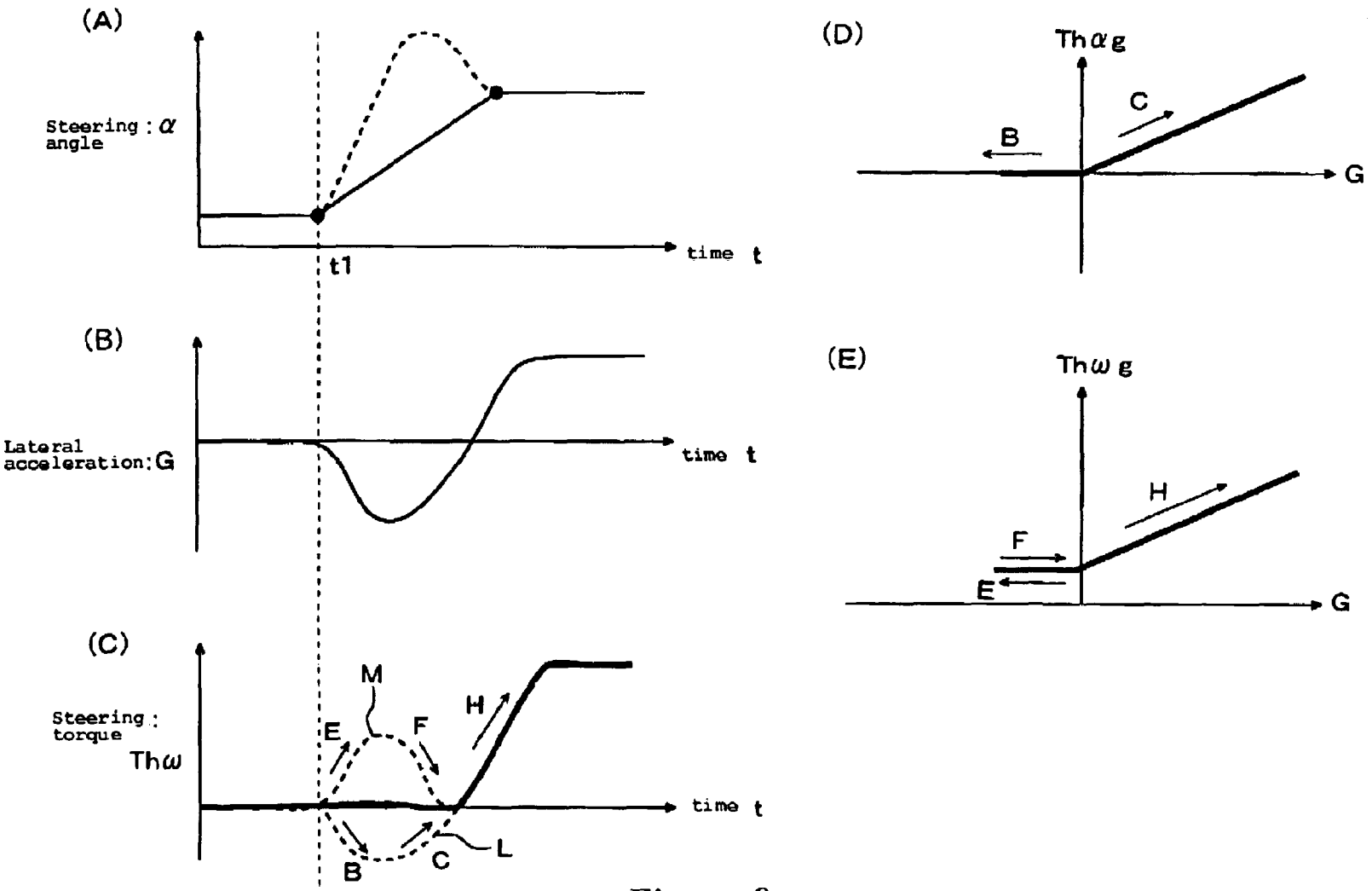
FIGS. 9(A), 9(B), 9(C), 9(D) and 9(E) are graphs illustrating exemplary methods of determining reaction torque in the initial phase of the turning of the steering wheel.

FIG. 7 is a flowchart of a steering method that can be used in conjunction with the steering systems described above.

Step S1:

A steering input angle α can be determined. For example, the steering angle sensor 9 (FIG. 2) can be used to detect the amount of steering wheel 7 displacement, or steering input angle α, when the steering wheel 7 has been turned. However, other techniques can also be used to determine the steering input angle α. The resulting steering input angle α data can be input to the controller 12 (FIG. 2).

Step S2:

The behavior of the boat 1 can be detected. For example, the controller 12 can detect the behavior of the boat using the behavior detection device 14 (FIGS. 1 and 2). However, other techniques can also be used for detecting behavior of the boat 1. The detected behaviors can include at least one of a yaw rate, lateral acceleration, a steering unit moving load, boat speed, roll angle, engine operating conditions such as acceleration or deceleration, or the like. Additionally, other behaviors can also be detected.

Step S3:

It can be determined whether or not the turning of the steering wheel is in an initial phase. For example, the controller 12 can determine whether or not the turning of the steering wheel is in the initial phase based on the detected behavior of the boat (see the description below with reference to FIG. 8).

Step S4:

If, in the Step S3, it is determined that the steering wheel movement is in an initial phase, the controller 12 can determine a reaction torque to the steering wheel 7 in response to the behavior in the initial phase of the turning.

Step S5:

If, in the Step S3, it is determined that the steering wheel movement is in an initial phase, the controller 12 can determine a reaction torque to the steering wheel 7 in response to the steering angle and the behavior.

Step S6:

A reaction force is applied to the steering wheel 7. For example, the controller can cause the reaction motor 11 to apply the reaction torque determined in step S4 or step S5 to the steering wheel 7.

With regard to the determination of reaction torque, in some embodiments, a steering input angle α and a roll angle θ of the boat can be used to determine whether the lateral acceleration is centrifugal (positive) or centripetal (negative). The determination of reaction torque can also be performed in response to the determined positive or negative lateral acceleration. Alternatively, the determination of reaction torque can be performed using a centrifugal force determined less a decrease in lateral acceleration due to the hull being tilted.

FIGS. 8(A) and 8(B) illustrate exemplary methods that can be sued for determining the initial phase of the turning of the steering wheel in accordance with some embodiments. In the example of FIGS. 8(A) and 8(B), the initial phase of the turning of the steering wheel 7 is determined in response to a steering angle α, a roll angle θ, a yaw rate γ and lateral acceleration G.

As shown in FIG. 8(A), the steering angle α, the roll angle θ (a centripetal direction is defined as positive) and the yaw rate γ all begin to increase with time at time point t1 when the turning of the steering wheel 7 begins. The lateral acceleration G (a centrifugal direction is defined as positive) first becomes negative and then increases as described above (FIG. 5). Changes in these physical quantities are shown in the table of FIG. 8(B). Using the steering angle $\alpha$, the roll angle $\theta$, the yaw rate $\gamma$ and the lateral acceleration G allows determination, as a whole, of the initial phase of the turning of the steering wheel 7 or during the steering movement after the initial phase.

FIGS. 9(A), 9(B), 9(C), 9(D) and 9(E) illustrate an exemplary method of determining reaction torque in the initial phase of the turning of the steering wheel 7.

FIG. 9(A) illustrates the characteristics of the steering input angle $\alpha$. According to some embodiments, in an exemplary operation, the steering input angle $\alpha$ can gradually increase with time as indicated by the solid line in the figure, and no excessive turning of the steering wheel 7 occurs in the middle as indicated by the dotted line (see FIGS. 5(A) and 6(A)).

FIG. 9(B) illustrates the characteristics of the lateral acceleration G. As with FIGS. 5(B) and 6(B), assuming that a centrifugal direction is positive, the lateral acceleration first becomes negative (centripetal) at time point t1 when the turning of the steering wheel 7 begins, and gradually becomes positive (centrifugal) thereafter.

FIG. 9(C) illustrates an example of determination of reaction torque. In some embodiments, no reaction torque is applied until the lateral acceleration G first becomes negative in the initial phase of the turning of the steering wheel 7 and then increases to approximately positive (solid line). For example, if negative reaction torque is applied in response to the lateral acceleration G in the initial phase of the turning as indicated by the dotted line L, the reaction torque will be applied in the direction in which the steering wheel 7 is turned, resulting in the increased possibility of excessive turning of the steering wheel 7 as discussed above with reference to FIG. 5(C).

On the other hand, if reaction torque is first increased in the initial phase of the turning as indicated by the dotted line M and then decreased again, the boat operator will be given an uncomfortable feeling during steering operation as described above with reference to FIG. 6(C). On the contrary, as indicated by the solid line, if reaction force is not applied in the initial phase of the turning of the steering wheel 7 but applied gradually after the lateral acceleration shifts from centripetal to centrifugal, excessive turning of the steering wheel 7 and uncomfortable feelings during steering wheel operation can be reduced or avoided.

FIG. 9(D) illustrates an example of determination of a coefficient Th$\alpha$g for determination of a reaction torque Th$\alpha$ in response to the lateral acceleration G based on the steering angle $\alpha$. FIG. 9(D) corresponds to FIG. 5(D) discussed above.

In FIG. 5(D), Th$\alpha$g is set to be negative when the lateral acceleration G is negative (centripetal). In contrast, as shown in FIG. 9(D), Th$\alpha$g can be kept at 0 when the lateral acceleration is negative. Th$\alpha$g is set so as to increase gradually after the lateral acceleration G becomes positive (centrifugal).

FIG. 9(E) illustrates an example of determination of a coefficient Th$\omega$g for determination of reaction torque Th$\omega$ in response to the lateral acceleration G based on the weight of the steering wheel 7. FIG. 9(E) corresponds to FIG. 6(D) discussed above. In FIG. 6(D), when the lateral acceleration is negative, Th$\omega$g is changed in response to the lateral acceleration. In contrast, as shown in FIG. 9(E), Th$\omega$g can remain unchanged when the lateral acceleration is negative.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A method for steering a boat with a marine propulsion unit at the stern, in which a reaction torque is applied to a steering wheel in response to external force to the boat, the method comprising:

detecting a steering angle and the behavior of the boat;

determining whether or not the turning of the steering wheel is in an initial phase based on the detected steering angle and the behavior of the boat; and applying the reaction torque to the steering wheel in response to the determination;

wherein determining whether or not the turning of the steering wheel is in an initial phase comprises determining if the lateral acceleration of the boat is negative.

2. The method for steering a boat according to claim 1, wherein detecting a behavior of the boat comprises detecting at least one of a yaw rate, lateral acceleration, a steering unit moving load, boat speed and a roll angle.

3. The method for steering a boat according to claim 1, wherein the step of applying the reaction torque is delayed such that no reaction torque is applied in the initial phase of the turning of the steering wheel.

4. A steering system for a boat, comprising:

a marine propulsion unit mounted to the stern through a steering device;

a reaction motor configured to apply a reaction torque to a steering wheel of the boat in response to external force to the boat;

a steering angle sensor;

a boat behavior detection device; and a controller configured to determine the reaction torque, the controller also being configured to determine whether or not the turning of the steering wheel is in an initial phase based on a steering angle and the behavior of the boat, and to determine the reaction torque based on the whether or not the steering wheel is in an initial phase;

wherein the boat behavior detection device is configured to detect a lateral acceleration of the boat, and wherein the controller is configured to determine that the turning of the steering wheel is in an initial phase if the lateral acceleration of the boat is negative.

5. The steering system according to claim 1, wherein the controller is configured to determined the behavior of the boat based on at least one of a yaw rate, lateral acceleration, a steering unit moving load, boat speed and a roll angle of the boat.

6. The steering system according to claim 1, wherein the controller is configured to delay the application of the reaction torque such that no reaction torque is applied in the initial phase of the turning of the steering wheel.

7. A steering system for a boat, comprising:

a marine propulsion unit mounted to the stern through a steering device;

a reaction motor configured to apply a reaction torque to a steering wheel of the boat in response to external force to the boat;

a steering angle sensor; and means for determining the reaction torque based on whether or not the turning of the steering wheel is in an initial phase based on a steering angle and a behavior of the boat;

wherein the means for determining includes means for determining that the turning of the steering wheel is in the initial phase if the lateral acceleration is negative.

8. The steering system according to claim 7, wherein the means for determining comprises means for determining the behavior of the boat based on at least one of a yaw rate, lateral acceleration, a steering unit moving load, boat speed and a roll angle of the boat.

9. The method for steering a boat according to claim 1, wherein determining whether or not the turning of the steering wheel is in an initial phase additionally comprises determining that the initial phase has ended when the lateral acceleration changes from negative to positive.

10. The steering system according to claim 4, wherein the controller is configured to determine that the initial phase has ended when the lateral acceleration changes from negative to positive.

* * * * *

UNITED STATES PATENT AND TRADEMARK OFFICE

CERTIFICATE OF CORRECTION

PATENT NO. : 7,465,200 B2
APPLICATION NO. : 11/516151
DATED : December 16, 2008
INVENTOR(S) : Makoto Mizutani It is certified that error appears in the above-identified patent and that said Letters Patent is hereby corrected as shown below:

Title Page 1, in Column 1, after Prior Publication Data, please insert --(30) Foreign Application Priority Data Sept. 2, 2005 (JP) ..... 2005-254759--.

In Column 1, Line 7 (Approx.), after "119", please insert --to--.

In Column 3, Line 44, please change "ransom" to --transom--.

In Column 7, Line 3, after "(centripetal)", please insert --at--.

In Column 7, Line 26 (Approx.), please change "characteristcs," to --characteristics,--.

Signed and Sealed this

Eleventh Day of May, 2010

David J. Kappos

David J. Kappos
*Director of the United States Patent and Trademark Office*